US009512854B2

(12) United States Patent
Wang

(10) Patent No.: US 9,512,854 B2
(45) Date of Patent: Dec. 6, 2016

(54) FAST ASSEMBLING CEILING FAN BLADES

(71) Applicant: AIR COOL INDUSTRIAL CO., LTD., Taichung (TW)

(72) Inventor: Cliff Wang, Taichung (TW)

(73) Assignee: AIR COOL INDUSTRIES CO., LTD., Taichung (TW)

( * ) Notice: Subject to any disclaimer, the term of this patent is extended or adjusted under 35 U.S.C. 154(b) by 585 days.

(21) Appl. No.: 14/025,980

(22) Filed: Sep. 13, 2013

(65) Prior Publication Data

US 2015/0078906 A1 Mar. 19, 2015

(51) Int. Cl.
*F04D 25/08* (2006.01)
*F04D 29/34* (2006.01)

(52) U.S. Cl.
CPC ..... *F04D 29/34* (2013.01); *F04D 25/088* (2013.01)

(58) Field of Classification Search
CPC ..... F04D 29/34; F04D 25/088
See application file for complete search history.

(56) References Cited

U.S. PATENT DOCUMENTS 5,180,284 A * 1/1993 Monrose, III ..... F04D 29/364 403/349
6,027,310 A * 2/2000 Kerr, Jr. ..... F04D 25/088 416/142
6,059,531 A * 5/2000 Tai ..... F04D 29/34 403/326
6,692,233 B2 * 2/2004 Liang ..... F04D 25/088 403/325
2003/0219340 A1 * 11/2003 Hidalgo ..... F04D 29/34 416/206
2009/0310949 A1 * 12/2009 Collier ..... F04D 25/088 392/361

* cited by examiner

*Primary Examiner* — Eric Keasel
*Assistant Examiner* — Jason Davis
(74) *Attorney, Agent, or Firm* — Ming Chow; Sinorica, LLC

(57) ABSTRACT

Fast assembling ceiling fan blades includes a motor housing having its outer circumferential side longitudinally provided with a plurality of gaps respectively secured therein with plural transverse engage blocks. A plurality of blades respectively have one side formed with a plurality of transverse guide grooves corresponding with the engage blocks of the gap, and each guide groove has its bottom extending upward to form an engage slot. Thus, one side of the blade, which corresponds to the engage blocks of the gap, can be pushed and fixed in the gap to have the engage blocks moved along the guide grooves and guided into the engage slots to enable the blade to be firmly engaged in the gap of the motor housing for quickly assembling the blades, simple, time-saving and convenient in assembly and disassembly of the ceiling fan blades.

4 Claims, 12 Drawing Sheets

FAST ASSEMBLING CEILING FAN BLADES

BACKGROUND OF THE INVENTION

1. Field of the Invention

This invention relates to a ceiling fan, particularly to fast assembling ceiling fan blades.

2. Description of the Prior Art

Conventional ceiling fan blades, as shown in FIG. 1, includes a motor 1 and a plurality of blades 2 that are firmly combined with the motor 1 by means of a plurality of blade holders 3 provided on the rotating shaft of the motor 1. The conventional ceiling fan blades 2 are respectively secured with the blade holders 3 by a plurality of locking members 4 so it is complicated in assembling procedures and necessary to take lots of time in assembly. In addition, if the conventional ceiling fan has to be disassembled for transferring, storing or replacing the blades 2, the numerous locking members 4 will cause much inconvenience in disassembly and reassembly of the blades 2 and after being unscrewed, the locking members 4 are likely to be lost due to careless storage. Therefore, it is necessary to probe into the defects of assembling of the conventional ceiling fan in order to develop ceiling fans that are comparatively convenient in assembly.

In view of this situation, the inventor of this invention, having many years of experience in specialized researching and manufacturing of various types of ceiling fans and related components and as well as in marketing, adheres to spirit of seeking for perfection and thinks it is necessary to ameliorate the assembling structure of the conventional ceiling fan blades and thus devises this invention.

SUMMARY OF THE INVENTION

The objective of this invention is to offer fast assembling ceiling fan blades, which are quick, simple, time-saving and convenient in assembly and disassembly and enables a user to operate manually by himself and is needless to employ any locking member.

The fast assembling ceiling fan blades in the present invention include a motor housing having its outer circumferential side longitudinally provided with a plurality of gaps respectively and transversely fixed therein with a plurality of engage blocks, and the gaps are for blades to be respectively engaged therein. The blades respectively have one side formed with a plurality of transverse guide grooves corresponding with the engage blocks of the gaps, and each guide groove has its bottom extending upward to form an engage slot.

Thus, one side of each blade, which corresponds to the engage blocks of the gap, can be set in the gap of the motor housing and then, the blade is pushed to move in the gap to have the engage blocks moved along the guide grooves and guided into the engage slots to enable the blade to be firmly engaged in the gap of the motor housing for securing the blade on the motor housing, quick, simple, time-saving and convenient in assembly and disassembly of the blades, able to be operated manually by a user himself and needless to use any locking member.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
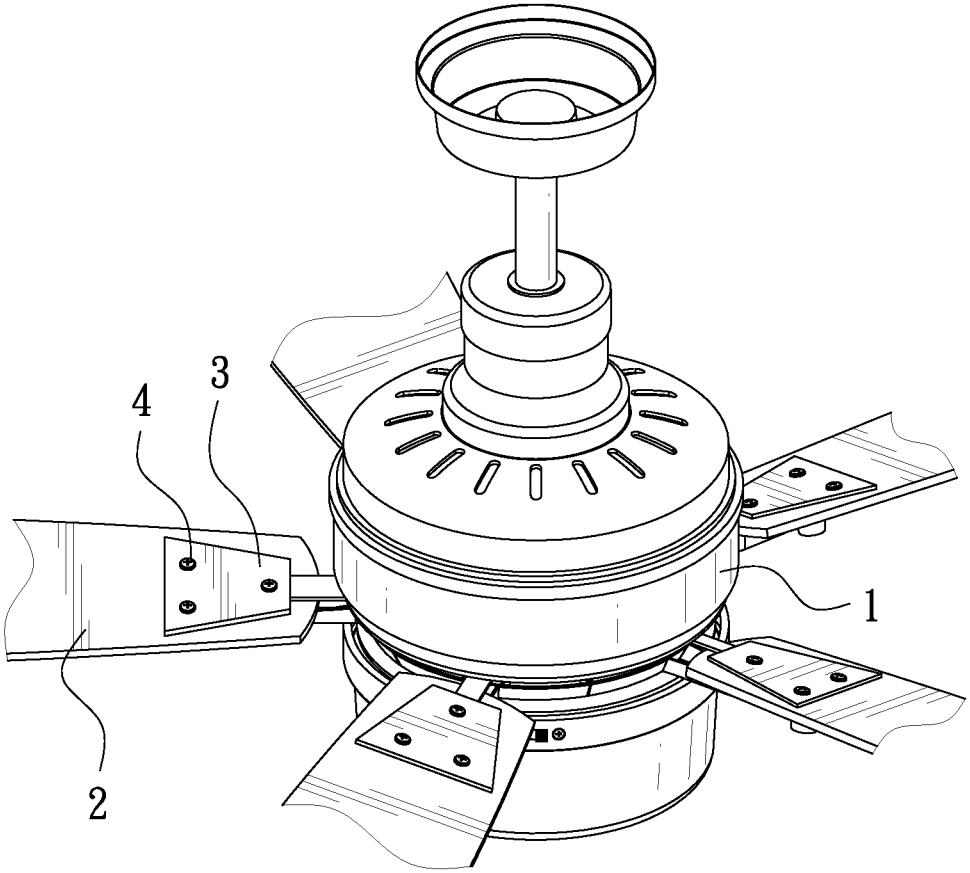
FIG. 1 PRIOR ART
FIG. 1 is a schematic view of conventional ceiling fan blades assembled.
Figure 2:
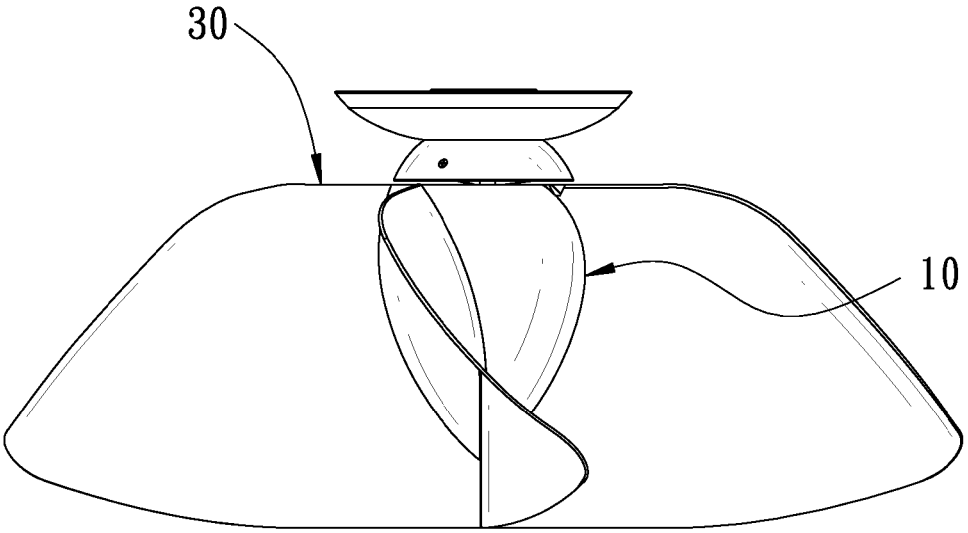
FIG. 2 is an assembled view of fast assembling ceiling fan blades in the present invention.
Figure 3:
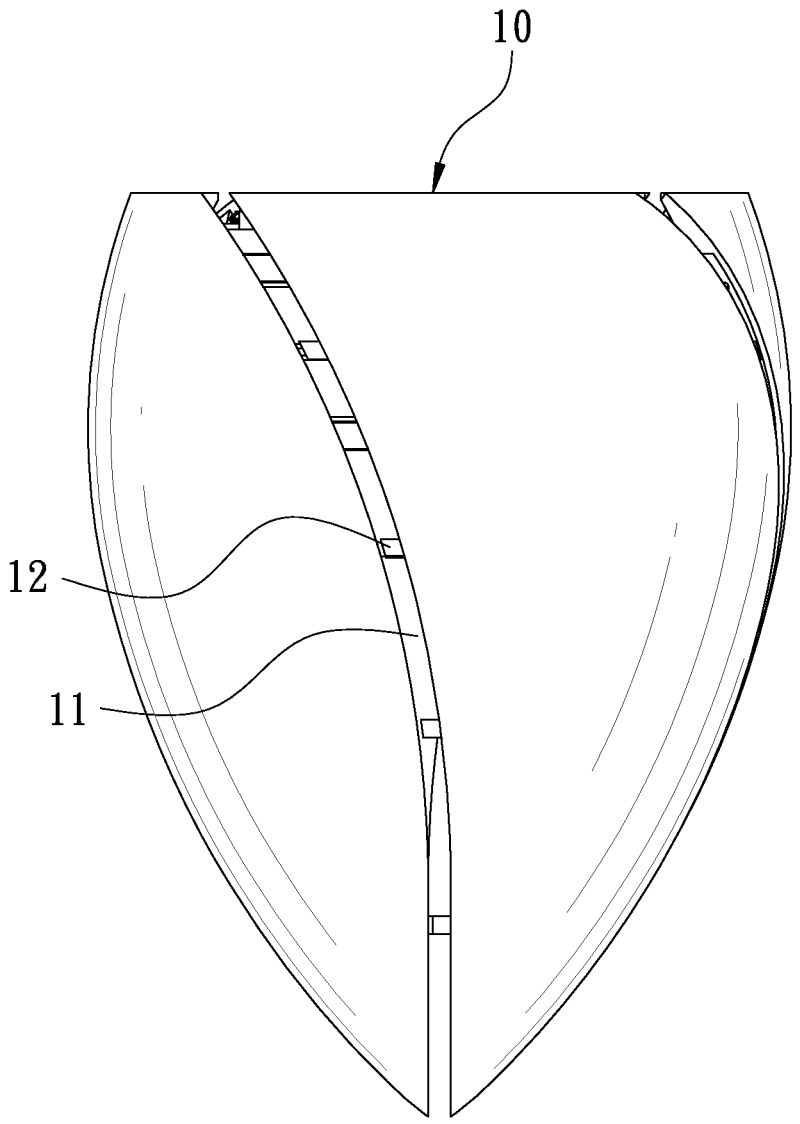
FIG. 3 is a side view of a motor housing in the present invention.

A preferred embodiment of fast assembling ceiling fan blades in the present invention, as shown in FIGS. 2-5, includes a motor housing 10, a plurality of stop members 20 and a plurality of blades 30 as main components combined together.

The motor housing 10 is composed of a plurality of arcuate plates assembled together, letting the motor housing 10 almost shaped as a downward tapered cone. The motor housing 10 has an outer circumferential side longitudinally provided with a plurality of gaps 11 extending upward to the upper side of the motor housing 10 and forming an opening 111. The gaps 11 extend from the upper edge to the lower edge of the motor housing 10 and form an arc-shape, and a plurality of engage blocks 12 spaced apart are transversely fixed in each gap 11 at predetermined locations, protruding from one inner wall to another inner wall of the gap 11 to stretch across the gap 11.

Figure 4:
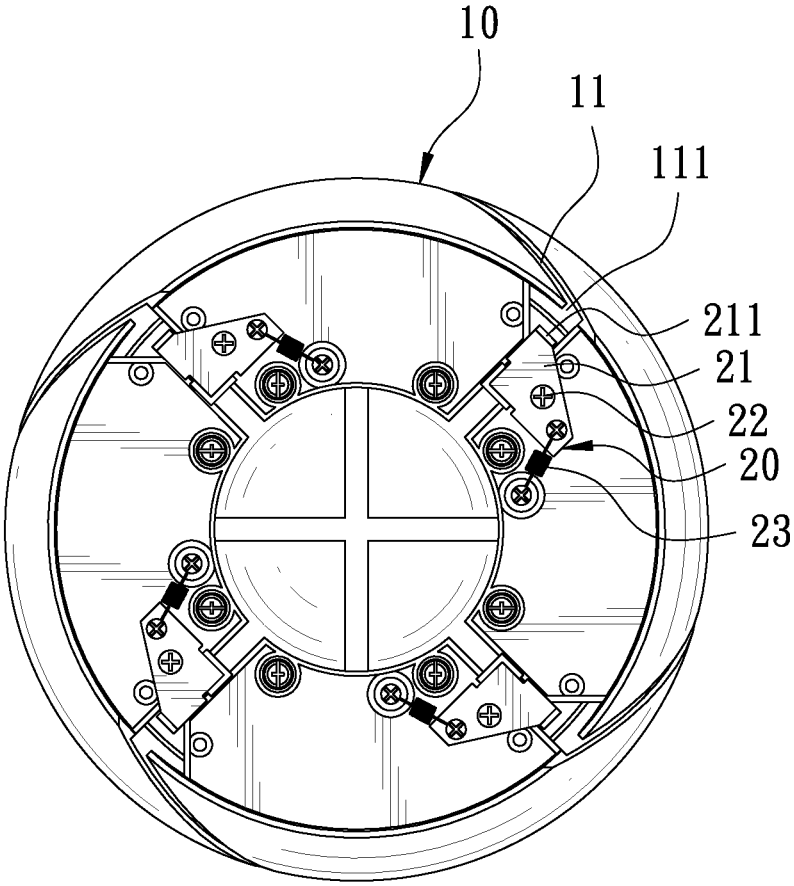
FIG. 4 is an upper view of the motor housing in the present invention.
Figure 5:
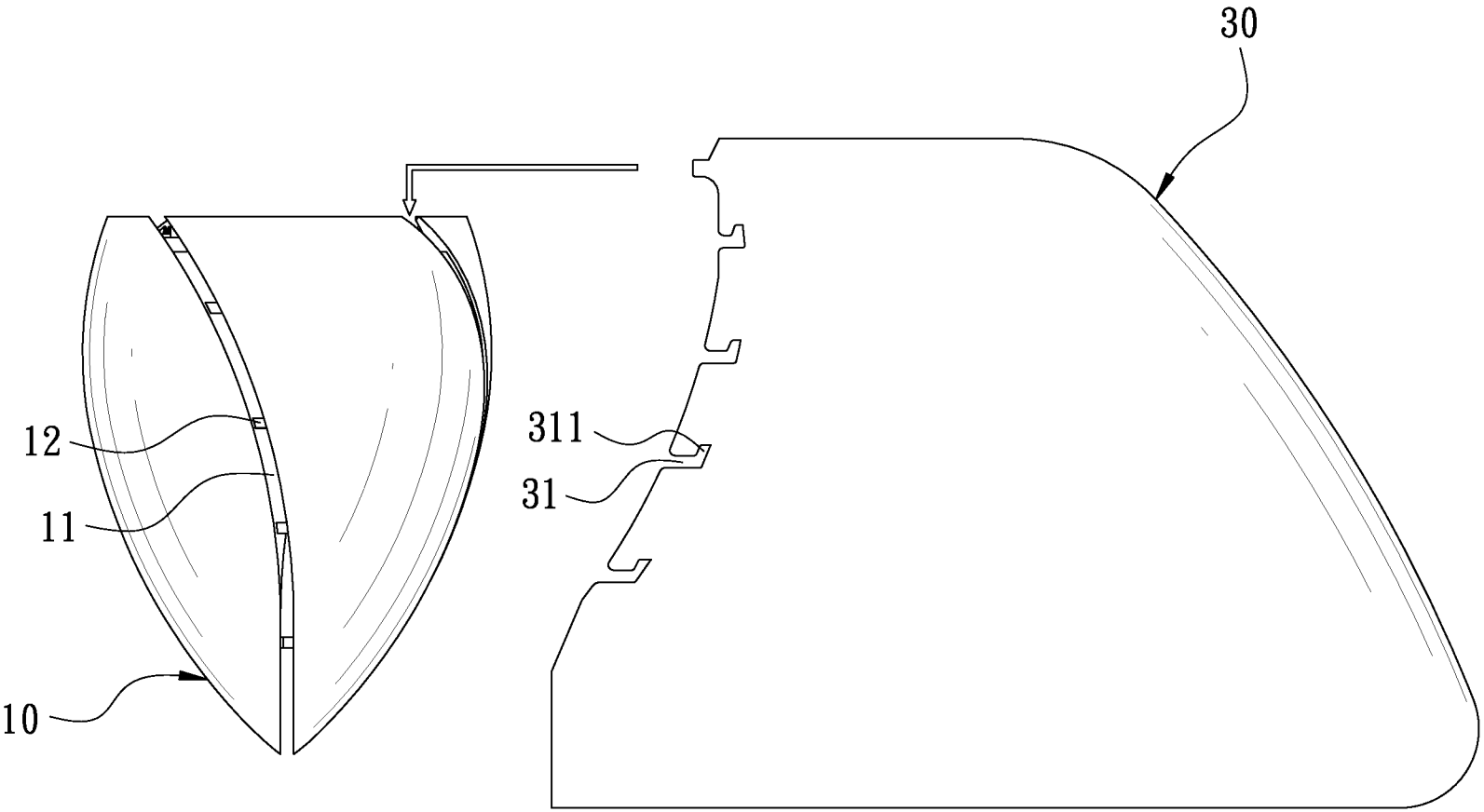
FIG. 5 is a schematic view of a ceiling fan blade to be assembled in the present invention.
Figure 6:
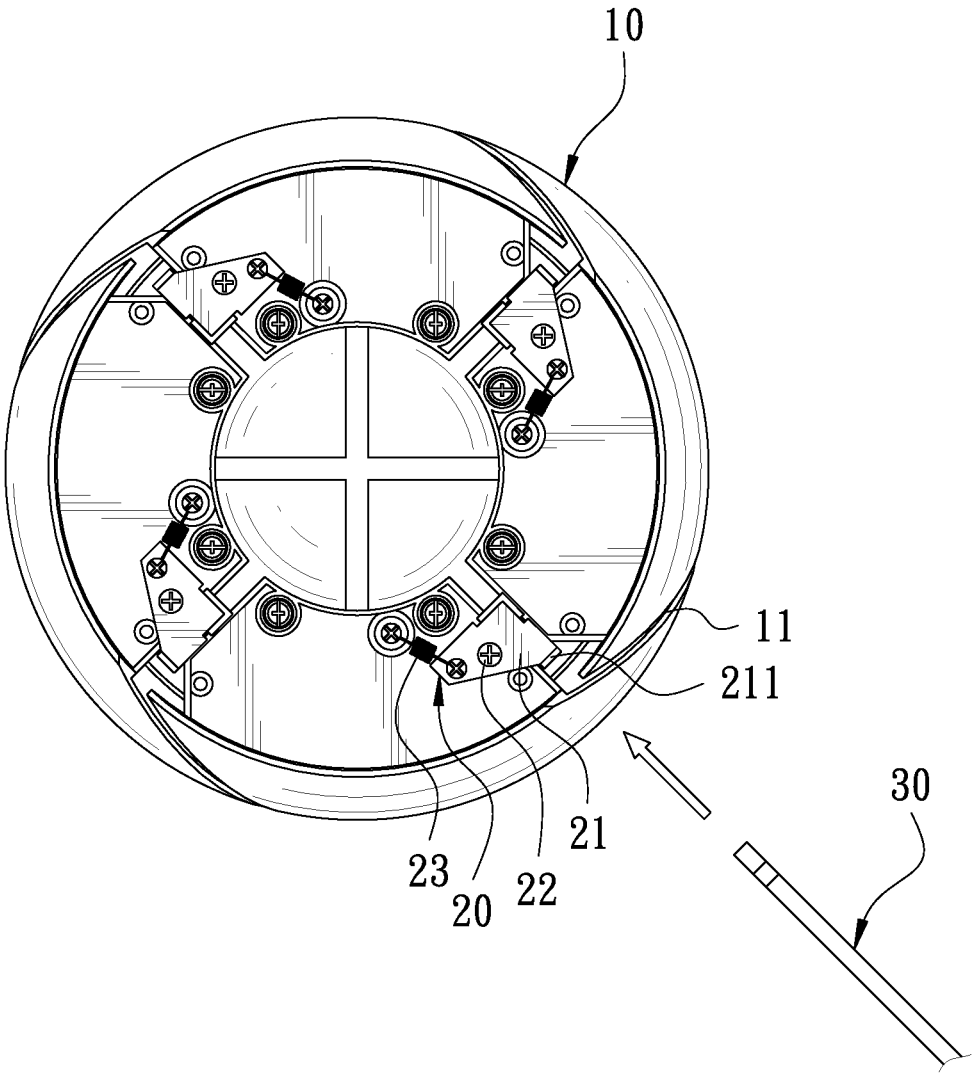
FIG. 6 is an upper view of assembly of a ceiling fan blade in the present invention, illustrating that one of the ceiling fan blades is to be engaged in the longitudinal gap of the motor housing.
Figure 7:
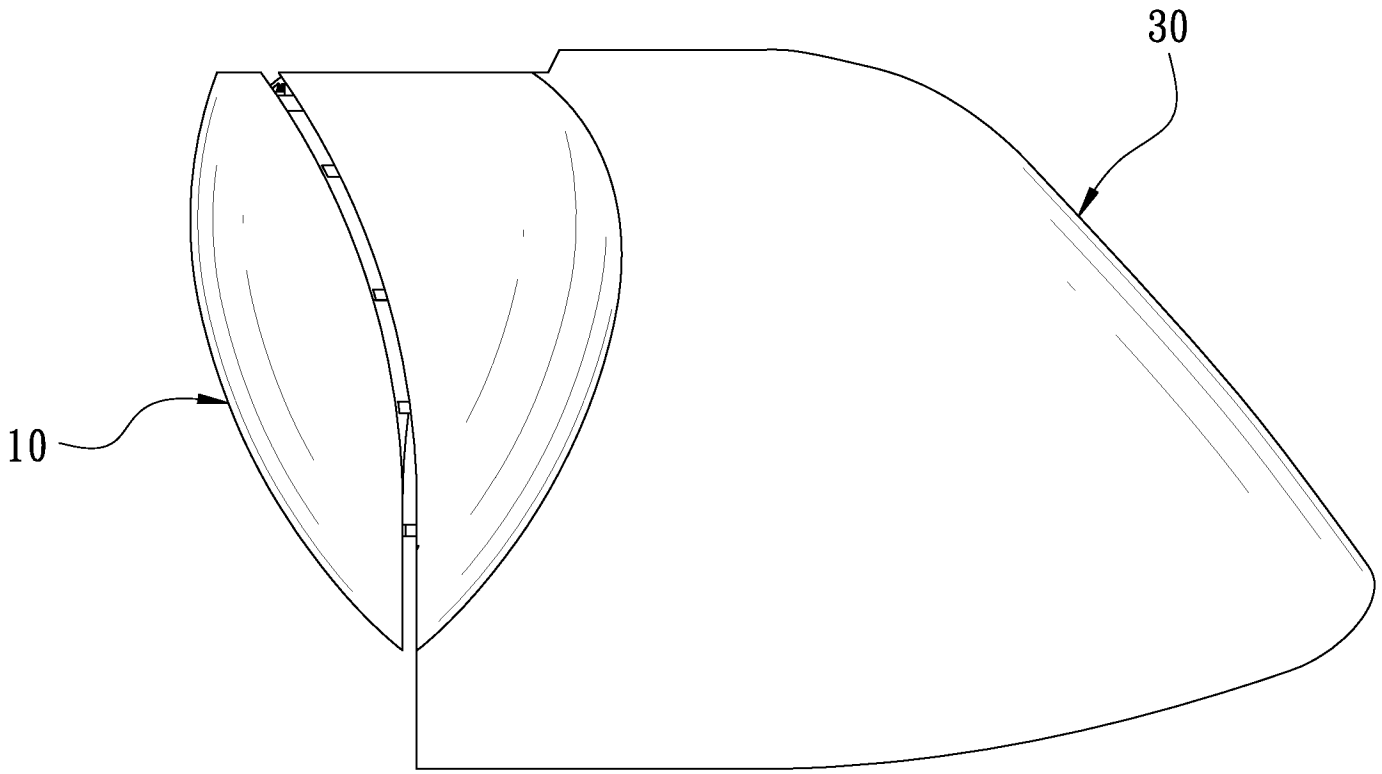
FIG. 7 is a schematic view of one of the ceiling fan blades in an assembled condition in the present invention.
Figure 8:
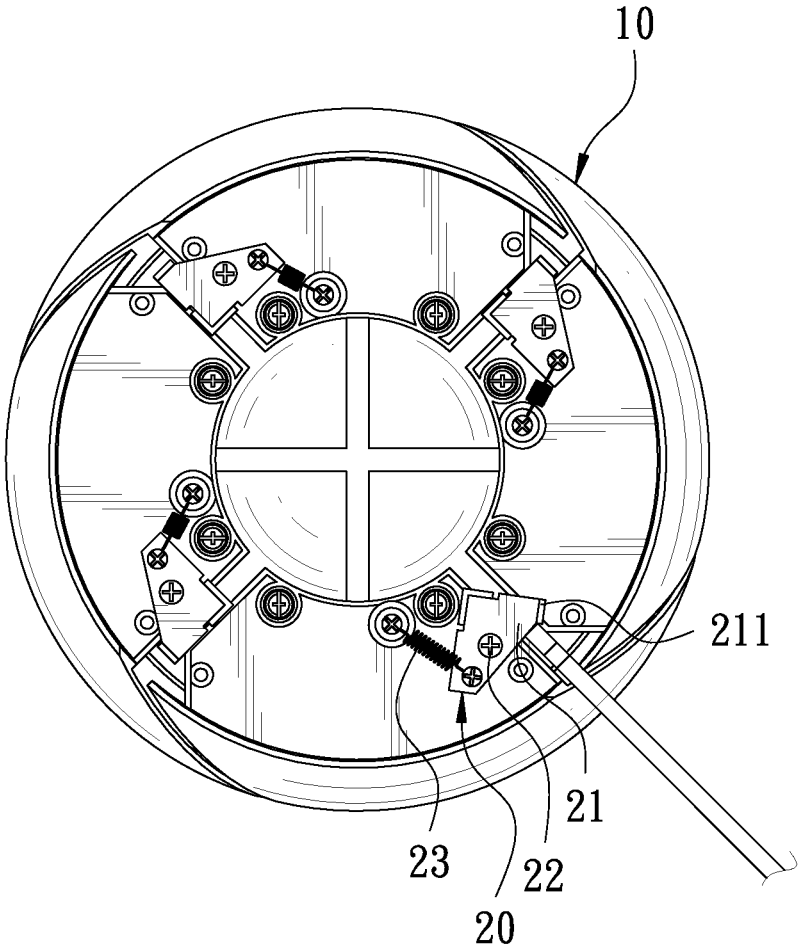
FIG. 8 is an upper view of assembly of one of the ceiling fan blades in the present invention, illustrating a condition that the ceiling fan blade pushes against a blade press-plate.
Figure 9:
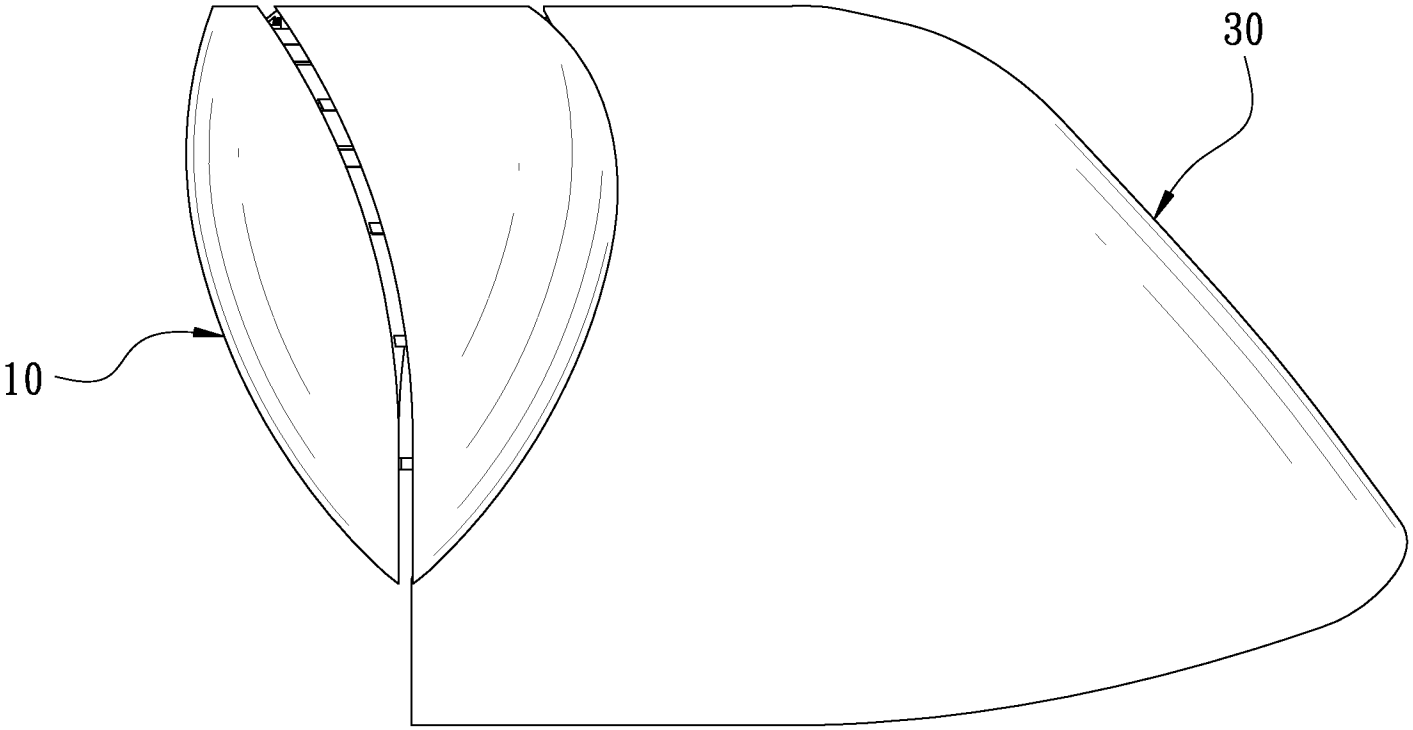
FIG. 9 is a schematic view of one of the ceiling fan blades in an assembled condition in the present invention.
Figure 10:
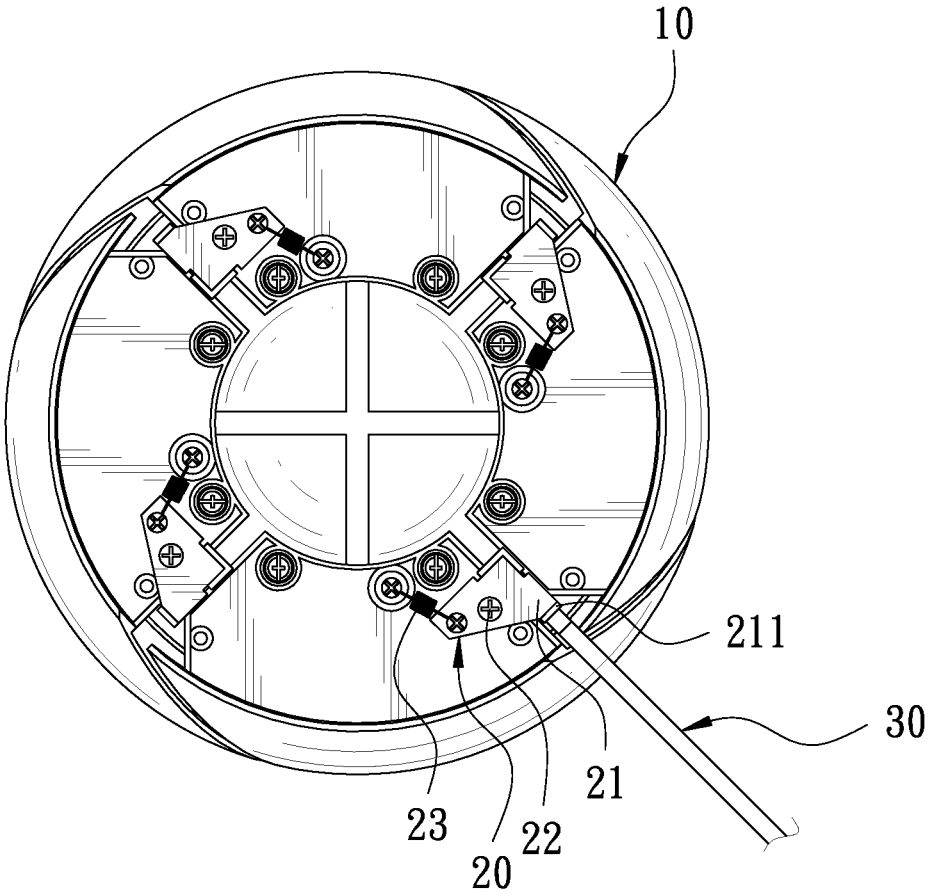
FIG. 10 is an upper view of assembly one of the ceiling fan blades in the present invention, illustrating that a blade press-plate is pressed on the ceiling fan blade.

The stop members 20 are assembled at the upper side of the motor housing 10 and respectively set at the location of the opening 111 of each gap 11. Referring to FIG. 4, each stop member 20 consists of a blade press-plate 21 pivotally provided at the upper side of the motor housing 10 by a pivot rod 22, which is fixed at an intermediate location of the blade press-plate 21. One side of the blade press-plate 21, which is distant from the pivot rod 22, has its peripheral edge formed with a resisting portion 211 on the gap 11, and another side of the blade press-plate 21, which is distant from the resisting portion 211, is provided with an extension spring 23, letting the pivot rod 22 positioned between the extension spring 23 and the resisting portion 211. The extension spring 23 has one end fixed with the blade press-plate 21 and another end secured at the upper side of the motor housing 10, extending in a reversed direction of the resisting portion 211 of the blade press-plate 21.

The blades 30 are respectively arc-shaped in longitudinal section for corresponding with the arcuate gaps 11, respectively having the peripheral edge of one side secured in the gap 11 of the motor housing 10. Each blade 30 has the peripheral edge of one side, which is to be fixed in the gap 11, disposed with a plurality of transverse guide grooves 31 respectively corresponding to the engage blocks 12 of the gap 11, and each guide groove 31 has its bottom further extended upward to form an engage slot 311, letting the guide groove 31 form into an L shape.

Referring to FIGS. 5-10, the blade press-plate 21 of this invention can be pivotally rotated, with the pivot rod 22 acting as a shaft center. When the blade press-plate 21 is not pushed by external force, the blade press-plate 21 is at a first position that makes the resisting portion 211 set on the gap 11. When the resisting portion 211 is pushed by external force, the blade press-plate 21, with the pivot rod 22 serving as a shaft center, will be pivotally rotated to make the resisting portion 211 move back toward the shaft direction of the motor housing 10 to have the blade press-plate 21 pivotally turned to a second position to enable the blade 30 to be pushed into the gap 11. When the blade press-plate 21 is no longer pushed by external force, the blade press-plate 21 will be pivotally rotated back to its first position by recovering elastic force of the extension spring 23.

In assembling of the blades 30, referring to FIGS. 5-10, only make the guide grooves 31 of the blade 30 respectively aligned to the engage blocks 12 of the motor housing 10 and have one side of the blade 30, which corresponds to the engage blocks 12, inserted into the gap 11. Then, the blade 30 is pushed to move in the gap 11 to let the peripheral edge of the blade 30 push the resisting portion 211 of the blade press-plate 21 and simultaneously the blade press-plate 21, with the pivot rod 22 acting as a shaft center, will be pivotally rotated from the first position to the second position to force the resisting portion 211 to move backward to enable the blade 30 to be completely engaged in the gap 11 and the engage blocks 12 respectively guided into the guide grooves 31. When the engage blocks 12 are moved along the guide groove 31 and guided to the bottom edge of the guide groove 31, the blades 30 are actuated to slide downward to let the engage blocks 12 move along the guide groove 31 and take advantage of an opportunity to be engaged in the engage slots 311. At this time, the blade 30 will slide downward to the underside of the blade press-plate 21 and disengage from the resisting portion 211 and at the mean time, the blade press-plate 21, with the pivot rod 22 acting as a shaft center, will be elastically moved back to the first position by the recovering elastic force of the extension spring 23 and pressed on the upper edge of the blade 30. Thus, the blade 30 can be firmly positioned in the gap 11 and the engage blocks 12 can be engaged in the engage slots 311 to prevent the blade 30 from sliding upward and falling off and hence, the blade 30 can be firmly secured on the motor housing 10. By so designing, the ceiling fan blades can quickly be assembled and disassembled manually by a user himself, simple, time-saving and convenient in assembly and disassembly of the ceiling fan blades 30. One thing worthy of mentioning is that fixation of the blades 30 can be further reinforced by the gaps 11 of the motor housing 10.

Figure 11:
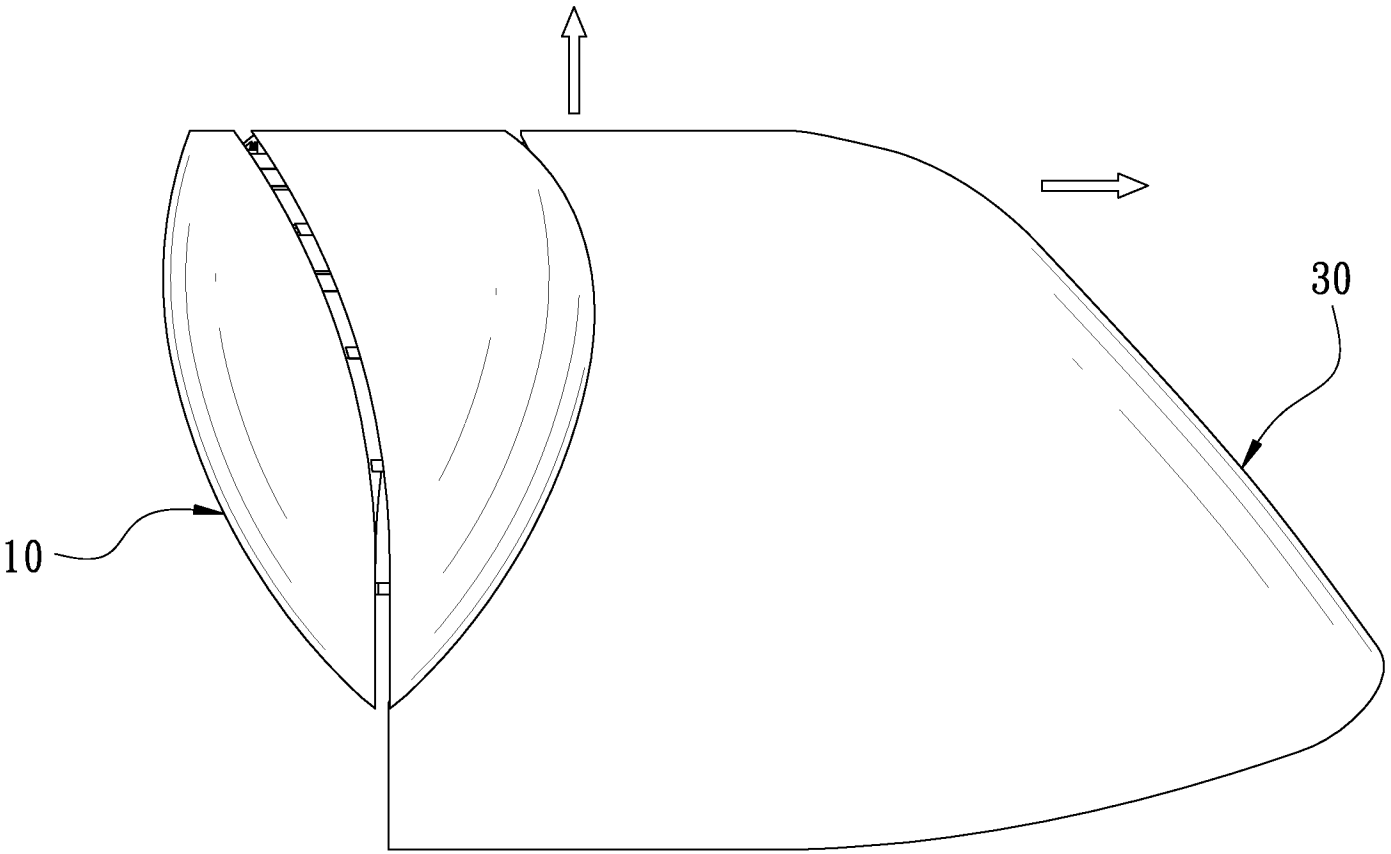
FIG. 11 is a schematic view of disassembly one of the ceiling fan blades in the present invention.
Figure 12:
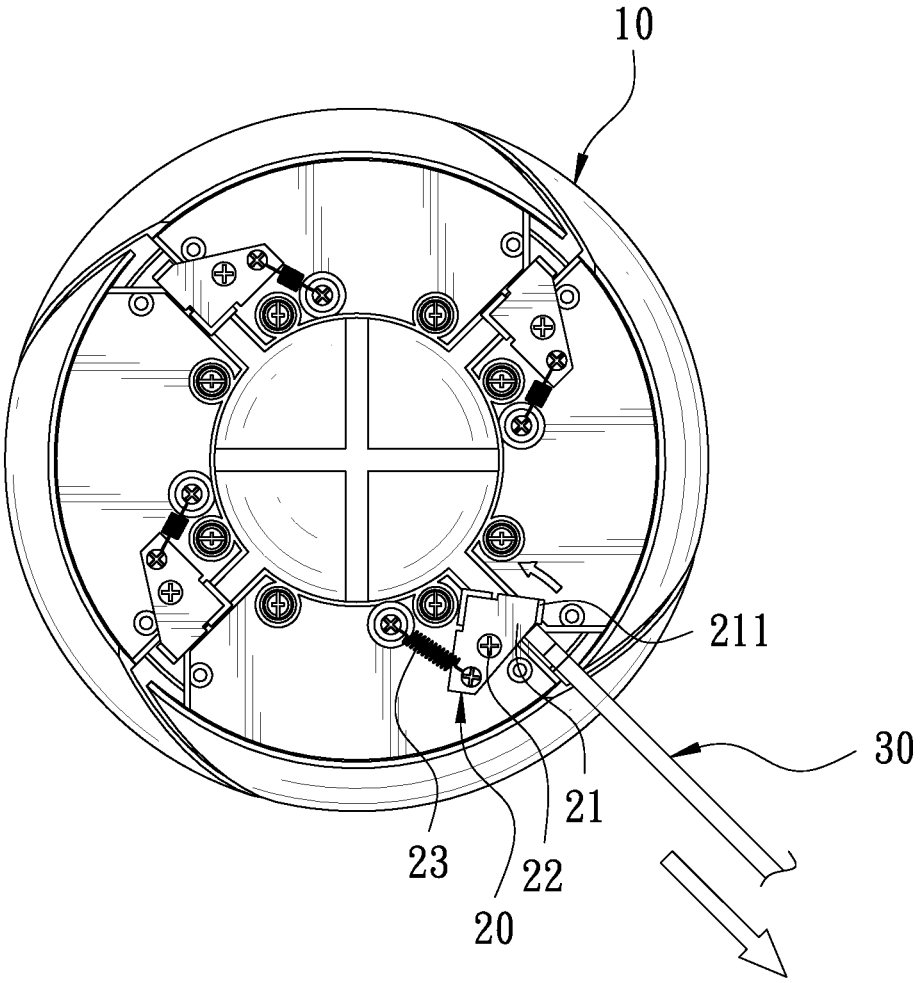
FIG. 12 is an upper view of disassembly of one of the ceiling fan blades in the present invention.

Referring to FIGS. 11 and 12, to disassemble the blade 30, simply have the resisting portion 211 of the blade press-plate 21 pushed backward to make the blade press-plate 21 pivotally rotated from the first position to the second position, with the pivot rod 22 serving as a shaft center, letting the blade press-plate 21 completely moved away from the upper edge of the blade 30 not to press the upper edge of the blade 30 any longer. Meanwhile, have the blade 30 slightly moved upward to let the engage blocks 12 disengaged from the engage slots 311 and then pull the blade 30 outward to have the engage blocks 12 disengaged from the guide grooves 31 and remove the blade 30 out of the gap 11 to disassemble the blade 30 from the motor housing 30, quick, simple, time-saving and convenient in disassembly of the ceiling fan blades and needless to employ any locking member.

While the preferred embodiment of the invention has been described above, it will be recognized and understood that various modifications may be made therein and the appended claims are intended to cover all such modifications that may fall within the spirit and scope of the invention.

What is claimed is:

1. Fast assembling ceiling fan blades comprising:

a motor housing having outer circumferential sides longitudinally provided with a plurality of gaps, each said gap of said motor housing transversely disposed with a plurality of engage blocks;

a plurality of blades, said blades respectively having an inner side, which corresponds to said engage blocks, formed with a plurality of transverse guide grooves, each said transverse guide groove having a bottom extending upward to form a recessed engage slot;

each said blade having one side, inserted in said gap, said blade pushed into said gap to have said engage blocks moved along said guide grooves and guided into said engage slots, said blade pushed downward to make said engage blocks respectively engaged in said engage slots, said blades able to be firmly engaged in said gaps of said motor housing, thus attaining effect of fast assembly of said blades;

said gaps are respectively extended upward to reach an upper side of said motor housing and form an opening at the upper side of said motor housing;

a plurality of stop members provided at the upper side of said motor housing, each said stop member provided at a location of said opening of a respective one of said gaps and this location defined to be a first position, said stop member able to be shifted from said first position to a second position when said stop member is pushed by external force, said blade able to be inserted and engaged in said gap when said stop member is shifted from said first position to said second position, said stop member actuated to move back to said first position when said blade is pushed downward to have said engage blocks engaged in said engage slots;

said blades having their upper edges respectively located under lower edges of said stop members so that said stop members can stop said blades from moving;

each said stop member is provided with a blade press-plate that is pivotally mounted at an upper side of said motor housing by a pivot rod;

said blade press-plate having one side, which is distant from said pivot rod, formed with a resisting portion at a peripheral edge;

said resisting portion positioned on said gap;

said blade press-plate having another side, which is far away from said resisting portion, provided with an extension spring, letting said pivot rod positioned between said extension spring and said resisting portion;

said extension spring having one end fixed with said blade press-plate and another end secured at an upper side of said motor housing;

said extension spring further provided with a reversed extension portion of said resisting portion toward said blade press-plate;

said blade press-plate able to be pivotally rotated with said pivot rod acting as a shaft center;

said blade press-plate being at said first position to keep said resisting portion set on said gap when said blade press-plate is not pushed by external force;

said blade press-plate, with said pivot rod serving as an axis center, pivotally rotated to said second position to enable said blade to be inserted in said gap when said resisting portion is pushed by external force and moved back toward the axis center of said motor housing; and said blade press-plate pivotally rotated back to said first position by recovering elastic force of said extension spring when said blade press-plate is no longer pushed by external force.

2. The fast assembling structure of ceiling fan blades as claimed in claim 1, wherein each said engage block protrudes from one inner sidewall to another inner sidewall of said gap to stretch across said gap.

3. The fast assembling structure of ceiling fan blades as claimed in claim 1, wherein said motor housing is gradually contracted downward to form a cone, and said gaps extend from an upper edge to a lower edge of said motor housing.

4. The fast assembling structure of ceiling fan blades as claimed in claim 1, wherein said gaps respectively form into an arcuate shape at outer circumferential sides of said motor housing, and said blades have their longitudinal sections respectively formed into an arc shape to correspond with said gaps so that said blades can be respectively engaged in said gaps.

* * * * *